US005358647A

United States Patent [19]

Puentes-Bravo et al.

[11] Patent Number: 5,358,647

[45] Date of Patent: * Oct. 25, 1994

[54] FABRIC SOFTENING PRODUCTS BASED ON A COMBINATION OF PENTAERYTHRITOL COMPOUND AND BENTONITE

[75] Inventors: Eduardo Puentes-Bravo, Alleur; Anita M. Hertmosilla, Othee; Jean-Paul M. H. F. Grandmaire, Andrimont; Viviane E. A. Tack, Ayeneux; Jan R. P. Doms, Tongeren; Marcel J. E. G. Gillis, Argenteau; Pierre M. Lambert, Cortil-Woden; Paul A. Heckles, Tilff, all of Belgium

[73] Assignee: Colgate-Palmolive Company, New York, N.Y.

[ * ] Notice: The portion of the term of this patent subsequent to Mar. 1, 2011 has been disclaimed.

[21] Appl. No.: 107,434

[22] Filed: Aug. 16, 1993

Related U.S. Application Data

[63] Continuation of Ser. No. 756,030, Sep. 6, 1991, abandoned, which is a continuation-in-part of Ser. No. 638,945, Jan. 9, 1991, Pat. No. 5,126,060.

[51] Int. Cl.[5] ..... D06M 10/08

[52] U.S. Cl. ..... 252/8.6; 252/8.9; 252/174.25

[58] Field of Search ..... 252/8.6, 8.7, 8.8, 8.9, 252/174.25

[56] References Cited

U.S. PATENT DOCUMENTS 4,126,562 11/1978 Goffinet et al. ..... 252/8.8
4,152,272 5/1979 Young ..... 252/8.8
4,162,984 7/1979 DeBlock et al. ..... 252/8.8
5,006,126 4/1991 Olson et al. ..... 252/8.8

FOREIGN PATENT DOCUMENTS 48-21353 6/1973 Japan .
0247370 2/1990 Japan .
4018169 1/1992 Japan .

*Primary Examiner*—Paul Lieberman
*Assistant Examiner*—Michael P. Tierney
*Attorney, Agent, or Firm*—Bernard Lieberman; Robert C. Sullivan

[57] ABSTRACT

A fabric softening product is a composition or article that is effective for its fabric softening purpose but preferably excludes ecotoxic quaternary ammonia salt, includes, as a fabric softening component, a PEC, which is an ester of pentaerythritol, an ester of an oligomer of pentaerythritol, an ester of a lower alkoxylated pentaerythritol or an ester of a lower alkoxylated pentaerythritol oligomer, with bentonite, which increases its fabric softening effect remarkably. The PEC is preferably a partial higher fatty acid ester of pentaerythritol or a partial higher fatty acid ester of a pentaerythritol oligomer, the bentonite is preferably sodium bentonite or swellable calcium bentonite, the fabric softening composition is a softergent or a non-detersive composition, both of which may be in solid (preferably particulate solid) or liquid state or form (preferably in aqueous suspension or gel), and the fabric softening article is an absorbent material with bentonite and PEC deposited on it or absorbed by it. Also within the invention are processes for softening fibrous materials of laundry contacting them with such compositions and/or articles during washing, rinsing and/or drying operations.

27 Claims, 1 Drawing Sheet

Figure 1:
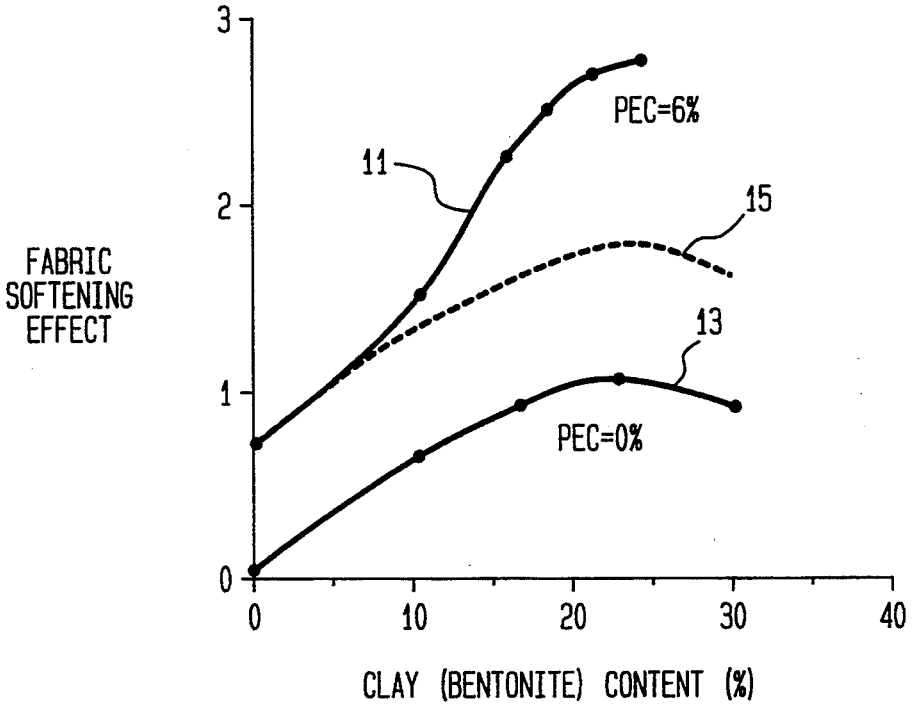

FABRIC SOFTENING PRODUCTS BASED ON A COMBINATION OF PENTAERYTHRITOL COMPOUND AND BENTONITE

This application is a continuation of application Ser. No. 07/756,030 filed Sep. 6, 1991, now abandoned which is a continuation-in-part of Ser. No. 07/638,945 filed Jan. 9, 1991, now U.S. Pat. No. 5,126,060.

This application is related to our application Ser. No. 07/755,965 now abandoned, entitled Fabric Softening Compositions Based on Pentaerythritol Compounds and Dispersant for Such a Compound, filed Sep. 6, 1991.

This invention relates to fabric softening products, which include fabric softening compositions and articles for applications to laundry during washing, rinsing and/or drying cycles. to apply to the fibers of the fabrics of such laundry fabric softening amounts of fabric softening components of such products. More particularly, it relates to such products that include as fabric softening components higher fatty acid esters of pentaerythritol, of pentaerythritol oligomers, or of ethoxylated derivatives of such pentaerythritol or oligomer esters, and any mixtures thereof, all of which may be designated PEC (for pentaerythritol compound), together with a clay of the montmorillonite type, very preferably bentonite, and which do not contain quaternary ammonium salts.

Fabric softening compositions and articles have long been employed to make washed laundry items softer to the touch and more comfortable to the wearer. Such compositions include solutions, emulsions and particulate and powder products, and such articles include paper strips and sponges that have been impregnated with fabric softener. The fabric softeners of choice for most commercial products have usually been quaternary ammonium salts, such as dimethyl ditallowyl ammonium chloride, and emulsions of such softener have been added to the rinse water in the washing machine to soften laundry. Alternatively, such emulsions or powder products including such fabric softener can be added to the wash water, with a detergent composition, or the detergent composition can include a fabric softening component, making it a so-called "softergent". Articles that contain a fabric softening component, such as a quaternary ammonium salt, may be added to the automatic laundry dryer wherein, during tumbling of the laundry in a heated environment, the fabric softener is applied to the laundry by repeated contact, and softens it.

Although various fabric softening (and antistatic) compositions, including softergents, have been marketed over the years, with varying degrees of commercial success, and although different fabric softening compounds have been included in them, the most successful of such compounds have been quaternary ammonium salts. Such compounds are often of the formula

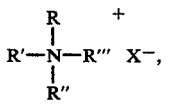

wherein R, R′, R″ and R‴ are all alkyl groups, with at least one of such alkyls being a higher alkyl (of 8 to 22 or 24 or of 12 to 18 carbon atoms) and with the others being lower alkyl(s) of 1 or 2 carbon atoms, and with $X^-$ being a salt-forming anion. Preferably, such quaternary ammonium salt is a di-lower alkyl, di-higher alkyl ammonium halide but mono-lower alkyl tri-higher alkyl ammonium halides have also found use in some instances.

While such quaternary ammonium salts have been effective fabric softeners in the described applications they are characterized by disadvantageous properties too, which have led to attempts to find replacements for them. For example, being cationic, they tend to react with anionic materials, such as anionic synthetic organic detergents and builders for synthetic detergents, sometimes to the detriment of their intended fabric softening function. They can deposit on laundry in such manner as to appear as greasy spots, which are highly objectionable. Finally, and perhaps most important, they are not as readily biodegradable as is desirable and they have been found to be toxic to aquatic organisms, which could lead to harmful effects on aquatic life in lakes, rivers and other waters into which waste waters carrying such compounds could eventually be emptied.

In efforts to find a replacement for quaternary ammonium salts as fabric softeners, neoalkanamides, glyceryl esters, glycol esters, silicones, cationic-anionic complexes, bentonite and various lubricants have been suggested for use alone or in conjunction with reduced amounts of the quaternary ammonium salts but frequently the softening effects thereof were insufficient or the replacement softeners possessed other characteristics which made them even less desirable than the quaternary ammonium salts. Now, however, applicants have discovered that the PEC's described herein, including the oligomers and lower alkoxylated derivatives, when employed in conjunction with a montmorillonite clay, such as a swellable bentonite, can satisfactorily soften laundry essentially to the same extent as the quaternary ammonium salts, and they don't exhibit the adverse effects of the quaternary ammonium salts on aquatic organisms. This is an especially important discovery at this time, when the seriousness of the problem is being recognized and when several countries are passing laws and promulgating regulations prohibiting the incorporation of quaternary ammonium compounds (hereafter "quats") in products that can be discharged into sewage and drainage systems. The invented compositions are surprisingly effective softergents, which clean as well as detergent compositions based on the same detersive components, and they also act synergistically with respect to fabric softening in non-detersive products, such as wash cycle and rinse additives, and dryer products, in all of which the combination of PEC and bentonite softens treated laundry significantly better than would be expected from the additive effect of such components. Moreover, whereas fabric softenings by each of the PEC and bentonite asymptotically approach limits which are below the excellent softening that is desirable, a composition containing PEC and bentonite softens significantly better and transcends such limits.

In accordance with the present invention a fabric softening product, which is a composition or an article for application to fibrous materials, so that a fabric softening component thereof is deposited on the fibrous materials and softens them, comprises a PEC, which is a fabric softening component which is a higher aliphatic acid ester of pentaerythritol, of an oligomer of pentaerythritol, of a lower alkylene oxide derivative of pentaerythritol or of a lower alkylene oxide derivative of an oligomer of pentaerythritol, or a mixture thereof, and a montmorillonite clay, very preferably bentonite. Of the PEC's those which are preferred are the pentaerythritol distearates and dipentaerythritol dilaurates, and of the montmorillonites, sodium and calcium bentonite are preferred. The invention also includes processes for softening laundry with the invented products.

A search of prior art relevant to the invention has resulted in the finding of the following:

U.S. Pat. Nos. 3,928,212; 4,126,562; 4,142,978; 4,162,984; and 4,214,038;

European Patent Application 276999-A;

German Patent Application 3612479-A; and

Japanese Patent 90 47,370.

U.S. Pat. No. 3,928,212 describes various softening agents which are polyhydric alcohol esters but none of them is a pentaerythritol ester or an ester of an oligomer or ethoxylated derivative of pentaerythritol or of an oligomer thereof. U.S. Pat. No. 4,126,562 mentions erythritol and pentaerythritol in a list of alcohols which may be reacted with higher fatty acids to produce fabric conditioning agents but no such compound is actually described and none is shown in a fabric softening composition or article. Also, U.S. Pat. No. 4,126,562 is for a combination of a quaternary ammonium salt fabric softener and a nonionic ester of an alcohol with a higher fatty acid, and there is no teaching that the ester would be useful alone as a fabric softener. U.S. Pat. No. 4,142,978 describes sorbitan esters with phase modifying components, such as alkyl sulfates, on a dryer sheet for softening laundry while it is being tumble dried in an automatic laundry dryer. The patent does not mention any pentaerythritol esters. U.S. Pat. No. 4,162,984 relates to a textile treatment emulsion of a water insoluble cationic fabric softener, which is preferably a quaternary ammonium salt or an alkylimidazolinium salt, with a water insoluble nonionic fabric softener, which is preferably a fatty acid ester of a mono- or polyhydric alcohol or an anhydride thereof, and an aromatic mono- or dicarboxylic acid. Among the polyhydric alcohols that may be esterified, according to the patent, is pentaerythritol, but no pentaerythritol ester is described specifically nor is any oligomer of pentaerythritol suggested, and none is shown to be a useful fabric softening agent in the absence of quaternary ammonium salt and aromatic carboxylic acid. It is clear that the patentees did not know of the present invention because they were aware of the disadvantages of the quaternary ammonium salt component (reaction with anionic detergent from the wash cycle) and found that its content could be reduced if the pentaerythritol ester and aromatic carboxylic acid were present, but they never recognized and apparently never made a fabric softening composition which did not contain quaternary ammonium halide or equivalent cationic fabric softener. U.S. Pat. No. 4,214,038 relates to polyglycerol esters as softening agents suitable for deposition on drying laundry from paper substrates charged to the laundry dryer with the laundry being dried. Although polyglycerol is a polyhydric alcohol, as is pentaerythritol, it is not the same as pentaerythritol and the patent does not suggest the use of applicants' pentaerythritol esters as fabric softeners. European patent specification 276999-A mentions fabric conditioning compotions that contain a non-cationic fabric softener and a nonionic cellulose ether. Although esters of polyhydric alcohols are mentioned as suitable conditioning agents, pentaerythritol esters are not disclosed. German patent specification 3612479-A describes textile softening compositions that contain quaternary ammonium compounds with carboxylic acid esters, and among the esters are those of various alcohols and polyols, including pentaerythritol. However, no such specific ester is described or even named, and no softening composition which does not contain quaternary ammonium compound as the fabric softener is disclosed. Japanese patent 90 47,370 discloses fabric softening compositions that are based on quaternary ammonium salts but may contain a higher fatty acid ester of pentaerythritol. No specific such ester is described in the abstract.

In none of the disclosures mentioned above is it taught that any pentaerythritol ester could be employed with a montmorillonite clay, such as bentonite, as a fabric softening combination, in place of a quaternary ammonium compound or quat softener and would have essentially as good or better a softening action, and none of the disclosures mentions any specific pentaerythritol ester nor does any mention any ester of an oligomer of pentaerythritol, of lower alkoxylated pentaerythritol or of an oligomer thereof as a fabric softening agent in a fabric softening composition. Thus, none of the references, either alone or in combination with any of the others, anticipates the present invention or makes it obvious.

A main component of the invented compositions and articles of the present invention, which is usually the main fabric softening compound in such products, other than the fabric softening clay, such as bentonite, which will also be present in them, is preferably a higher fatty acid ester of a pentaerythritol compound, which term is used in this specification to describe higher fatty acid esters of pentaerythritol, higher fatty acid esters of pentaerythritol oligomers, higher fatty acid esters of lower alkylene oxide derivatives of pentaerythritol and higher fatty acid esters of lower alkylene oxide derivatives of pentaerythritol oligomers. Pentaerythritol compound may be abbreviated as PEC herein, which description and abbreviation may apply to any or all of pentaerythritol, oligomers, thereof and alkoxylated derivatives thereof, as such, or more preferably and more usually, as the esters, as may be indicated by the context.

The oligomers of pentaerythritol are preferably those of two to five pentaerythritol moieties, more preferably 2 or 3, with such moieties being joined together through etheric bonds. The lower alkylene oxide derivatives thereof are preferably of ethylene oxide or propylene oxide monomers, dimers or polymers, which terminate in hydroxyls and are joined to the pentaerythritol or oligomer of pentaerythritol through etheric linkages. Preferably there will be one to ten alkylene oxide moieties in each such alkylene oxide chain, more preferably 2 to 6, and there will be one to ten such groups on a PEC, depending on the oligomer. At least one of the PEC OH groups and preferably at least two, e.g., 1 or 2 to 4, are esterified by a higher fatty acid or other higher aliphatic acid, which can be of an odd number of carbon atoms.

The higher fatty acid esters of the pentaerythritol compounds are preferably partial esters And more preferably there will be at least two free hydroxyls thereon after esterification (on the pentaerythritol, oligomer or alkoxyalkane groups). Frequently the number of such free hydroxyls is two or about two but sometimes it may be one, as in pentaerythritol tristearate, or as many as eight, as in pentapentaerythritol tetrapalmitate.

The higher aliphatic or fatty acids that may be employed as esterifying acids are those of carbon atom contents in the range of 8 to 24, preferably 12 to 22 and more preferably 12 to 18, e.g., lauric, myristic, palmitic, oleic, stearic and behenic acids. Such may be mixtures of such fatty acids, obtained from natural sources, usch as tallow or coconut oil, or from such natural materials that have been hydrogenated. Synthetic acids of odd or even numbers of carbon atoms may also be employed. Of the fatty acids lauric and stearic acids are often preferred, and such preference may depend on the pentaerythritol compound being esterified.

Examples of some esters (PEC's) within the present invention follow:

MONOPENTAERYTHRITOL ESTERS

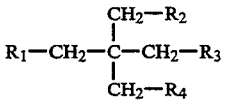

MONOPENTAERYTHRITOL DILAURATE
$R_1 = CH_3-(CH_2)_{10}-COO-$
$R_2 = CH_3-(CH_2)_{10}-COO-$
$R_3 = OH$
$R_4 = OH$

MONOPENTAERYTRITOL MONOSTEARATE
$R_1 = CH_3-(CH_2)_{16}-COO-$
$R_2 = OH$
$R_3 = OH$
$R_4 = OH$

MONOPENTAERYTHRITOL DISTEARATE
$R_1 = CH_3-(CH_2)_{16}-COO-$
$R_2 = CH_3-(CH_2)_{16}-COO-$
$R_3 = OH$
$R_4 = OH$

MONOPENTAERYTHRITOL TRISTEARATE
$R_1 = CH_3-(CH_2)_{16}-COO-$
$R_2 = CH_3-(CH_2)_{16}-COO-$
$R_3 = CH_3-(CH_2)_{16}-COO-$
$R_4 = OH$

MONOPENTAERYTHRITOL MONOBEHENATE
$R_1 = CH_3-(CH_2)_{20}-COO-$
$R_2 = OH$
$R_3 = OH$
$R_4 = OH$

MONOPENTAERYTHRITOL DIBEHENATE
$R_1 = CH_3-(CH_2)_{20}-COO-$
$R_2 = CH_3-(CH_2)_{20}-COO-$
$R_3 = OH$
$R_4 = OH$

DIPENTAERYTHRITOL ESTERS

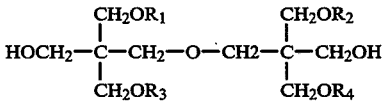

DIPENTAERYTHRITOL TETRALAURATE
$R_1 = CH_3-(CH_2)_{10}-CO$
$R_2 = CH_3-(CH_2)_{10}-CO$
$R_3 = CH_3-(CH_2)_{10}-CO$
$R_4 = CH_3-(CH_2)_{10}-CO$

DIPENTAERYTHRITOL TETRASTEARATE

-continued $R_1 = CH_3-(CH_2)_{16}-CO$
$R_2 = CH_3-(CH_2)_{16}-CO$
$R_3 = CH_3-(CH_2)_{16}-CO$
$R_4 = CH_3-(CH_2)_{16}-CO$

PENTAERYTHRITOL
10 ETHYLENE OXIDE ESTER:

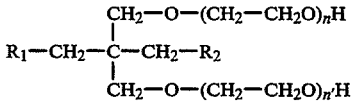

with $n + n' = 10$

MONOPENTAERYTHRITOL
10 ETHYLENE OXIDE DISTEARATE:
$R_1 = CH_3-(CH_2)_{16}-COO-$
$R_2 = CH_3-(CH_2)_{16}-COO-$

PENTAERYTHRITOL
4 PROPYLENE OXIDE ESTERS

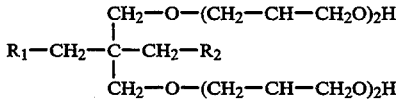

MONOPENTAERYTHRITOL
4 PROPYLENE OXIDE MONOSTEARATE
$R_1 = CH_3-(CH_2)_{16}-COO-$
$R_2 = OH$

MONOPENTAERYTHRITOL
4 PROPYLENE OXIDE DISTEARATE
$R_1 = CH_3-(CH_2)_{16}-COO-$
$R_2 = CH_3-(CH_2)_{16}-COO-$

MONOPENTAERYTHRITOL
4 PROPYLENE OXIDE MONOSEHENATE
$R_1 = CH_3-(CH_2)_{20}-COO-$
$R_2 = OH$

MONOPENTAERYTHRITOL
4 PROPYLENE OXIDE DISEHENATE
$R_1 = CH_3-(CH_2)_{20}-COO-$
$R_2 = CH_3-(CH_2)_{20}-COO-$

Although in the formulas given herein some preferred pentaerythritol compounds that are useful in the practice of this invention are illustrated it will be understood that various other such pentaerythritol compounds within the description thereof herein may be employed too, including such as pentaerythritol dihydrogenated tallowate, pentaerythritol ditallowate, pentaerythritol dipalmitate, and dipentaerythritol tetratallowate. Also, in this specification when reference is to a compound of a class, unless it is indicated otherwise therein it is to be considered that the employment of mixtures of compounds of such class are intended to be included (commercial compounds are often mixtures).

The PEC's utilized in this invention can have fabric softening effects but such activities are remarkably increased when a montmorillonite clay (bentonite) is also present. In the absence of such bentonite the PEC may be substantially undispersed in wash and rinse waters, and may be less evenly and less strongly applied to laundry from softening articles. It has been found that better dispersed PEC has greater softening activity. When undispersed the PEC could be in solid agglomerate form when cold or in molten form when hot, in neither of which states does it act as effectively to soften fabrics (and in both of which cases it can deposit objectionably on treated materials to produce somewhat greasy spotting thereof). The bentonite acts to disperse the PEC to make it more effective as a softener, and at the same time such "dispersing agent" also acts as a softener, which avoids the undesirable dilution of softening action by an ordinary dispersing agent, and it synergistically improves fabric softening.

The clays that are useful components of the invented products are those which cooperate synergistically with the PEC's to soften laundry better than would be expected from such a combination. Such clays include the montmorillonite-containing clays which have swelling properties (in water) and which are of smectite structure, so that they deposit on fibrous materials, especially cotton and cotton/synthetic blends, such as cotton/-polyester, to give such fibers and fabrics made from them a surface lubricity or softness. The best of the smectite clays for use in the present invention is bentonite and the best of the bentonites are those which have a substantial swelling capability in water, such as the sodium and potassium bentonites. Such swelling bentonites are also known as western or Wyoming bentonites, which are essentially sodium bentonite. Other bentonites, such as calcium bentonite, are normally non-swelling and usually are, in themselves, unacceptable as fabric softening agents. However, the present inventors have found that such non-swelling bentonites exhibit even better fabric softening in combination with PEC's than do the swelling bentonites, provided that there is present in the composition being tested for softness, a source of alkali metal or other solubilizing ion, such as sodium (which may come from sodium hydroxide, added to the composition, or from sodium salts, such as builders and fillers, which may be functional components of the composition). This utility of the normally non-swelling bentonite is surprising and the superiority of such in the invented compositions (when a source of sodium is present) over normally swelling bentonite, such as sodium bentonite, is very surprising. Among the preferred bentonites are those of sodium and potassium, which are normally swelling, and calcium and magnesium, which are normally non-swelling. Of these it is preferred to utilize calcium (with a source of sodium being present) and sodium bentonites. The bentonites employed are not limited to those produced in the United States of America, such as Wyoming bentonite, but also may be obtained from Europe, including Italy and Spain, as calcium bentonite, which may be converted to sodium bentonite by treatment with sodium carbonate, or may be employed as calcium bentonite. Also, other montmorillonite-containing smectite clays of properties like those of the bentonites described may be substituted in whole or in part for the bentonites described herein and similar fabric softening results will be obtained.

The swellable bentonites and similarly operative clays are of ultimate particle sizes in the micron range, e.g., 0.01 to 20 microns and of actual particle sizes in the range of No's. 100 to 400 sieves, preferably 140 to 325 sieves, U.S. Sieve Series. Such size ranges also apply to the zeolite builders, which will be described later herein. The bentonite and other such suitable swellable clays may be agglomerated to larger particle sizes too, such as 60 to 120 sieves, but such agglomerates are not preferred unless they include the PEC('s) too (in any particulate products).

Liquid state preparations of this invention may be emulsions (which term herein is also intended to refer to dispersions and suspensions in liquid media, as well as to emulsions), and any of such "emulsions" will normally be aqueous emulsions in which the aqueous phase is the continuous phase. However, solvents and cosolvents, such as ethanol, isopropanol, propylene glycol and various mono- and di-lower alkyl esters of diethylene glycol (Carbitols ®) may also be present in such emulsions and microemulsions to promote formations of more stable products, and may also be in the continuous media. Suitable dispersing agents, such as emulsifiers, can be employed with the mentioned clay to further help it to disperse the PEC in aqueous media. Such are useful in liquid and solid (including particulate) products.

Various emulsifiers can be employed, and many such are described in the various *Detergents and Emulsifiers* publications of John W. McCutcheon, issued annually, particularly those for 1969, 1973, 1980 and 1981, which are incorporated herein by reference. Preferred such emulsifiers are those which are alkyl ethers or amines which contain one or more hydroxalkyl substituents too. Of these the more preferred are the alkyl dialkanolamines or alkyl trialkanolpropylenediamines wherein the alkanol moieties are of 2 to 4 carbon atoms, preferably being 2 or 3 and more preferably being 2, and the alkyl poly(ethylene oxide) ethers are of 2 to 24 ethylene oxide units, preferably of 8 to 12 ethylene oxide units, in which emulsifiers the alkyl is of 8 to 24, preferably 12 to 18 carbon atoms. More preferred such emulsifiers are: stearyl diethanolamine, available from Hoechst A. G. as Genamin ® S-020; tallow triethanol propylenediamine, available from CECA, S.A. as Dinoramox ®; and $R—O—(CH_2CH_2O)_{10}H$, wherein R is a mixture of $C_{12-15}$ alkyls, available from Hoechst A. G. as Gena-Pol ® OH-100.

When instead of emulsion form for the invented compositions it is desired that they be in particulate, powder, solid or gel form less water or moisture or even none is present but the bentonite will still usually be of small (micron range) ultimate size. Instead of or in addition to the bentonite there may be present other swellable montmorillonite clays and there may also be present with the bentonite other non-functional substantially water insoluble carriers or dispersing agents, such as calcium carbonate and silica. Even water soluble carriers, such as sodium sulfate and other "filler salts" may be used, at least in part, and such can sometimes act as dispersing agents, too. The bentonite employed should desirably be of a type which is gel forming in water and capable of softening fibrous materials, and should be of micron range ultimate particle size, although it may be agglomerated to larger sizes, usually in the range of 8 to 140 sieves, U.S. Sieve Series.

When the pentaerythritol compound softening agent is to be applied to laundry being dried in a laundry dryer, such as an automatic dryer, the PEC and bentonite may be applied to a substrate material, from which it may be transferred to the drying laundry under the influence of the heat in the drying air and the rubbing action of the substrate against the moving laundry. The substrate used may be paper or other fibrous material, sponge, preferably cellulose or polyurethane, or other suitable base material, with the pentaerythritol compound being such that it is solid at room temperature and liquefiable and/or softenable at dryer temperatures. The PEC may be blended with other suitable waxy type material, plasticizer or hardener to control the softening point thereof, when such is desirable. In use of such articles the bentonite helps to distribute or spread the PEC on the substrate and the PEC helps to promote adherence of the bentonite to the substrate. Additionally, the bentonite's positive charge helps the PEC to adhere to usually negatively charged laundry.

Normally, in the various applications mentioned, the PEC will be employed without the presence of any other fabric softening material (except the clay, such as bentonite, montmorillonite or other operative smectite) but it is possible to utilize such other materials with it if in the proportions and quantities employed they are not ecologically unacceptable and if they do not interfere with the fiber softening action of the PEC. In fact, sometimes, when antistatic action is desirable in the product, such additions may be important because although PEC's have some antistatic properties sometimes those are insufficient for the intended purposes. Thus, it is possible to formulate fabric softening compositions and articles with the PEC supplemented by other antistatic agents and also by fabric softeners. The foremost of such antistatic materials are the quaternary ammonium salts but when they are present there can be ecological problems, due to their toxicities to aquatic organisms. For example, in standard toxicity tests against daphnia the concentration for 50% effect is less than 1 mg./l. for quaternary ammonium compounds or quats, such as ditallowalkyl dimethyl ammonium chloride, and that is often unacceptable, environmentally, so in such circumstances quats are not employed. Other antistats and fabric softeners include: higher alkyl neoalkanamides, e.g., N-stearyl neodecanamide; isostearamides; amines, such as N,N-ditallowalkyl N-methyl amine; esterified quaternary salts or esterquats; amidoamines; amidoquats; imidazolines; imidazolinium salts; di-higher fatty acid esters of di-lower alkanolamies, such as dicoco acid ester of diethanolamine; silicones; and alkoxylated silicones; and representative examples of some of such classes of such compounds are given below (those which may cause significant ecological harm will desirably be avoided).

QUAT

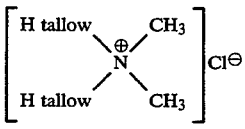

ESTERQUAT

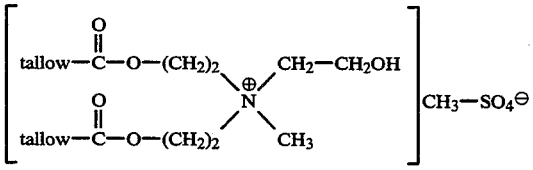

AMIDO AMINE

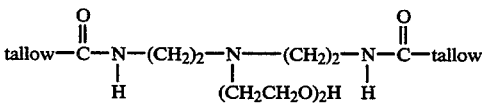

AMIDO QUAT

-continued

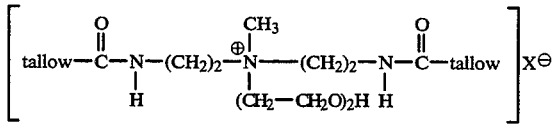

IMIDAZOLINE

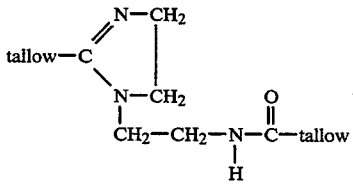

IMIDAZOLINIUM SALT

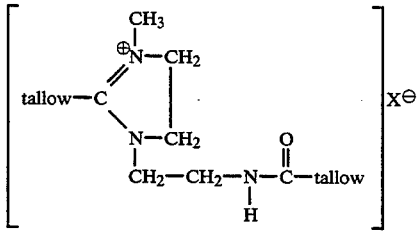

SILICONE = polydimethylsiloxane

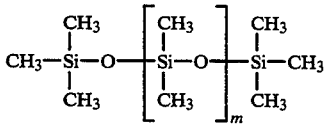

It should be kept in mind when employing supplementary antistats and fabric softeners that they shouldn't make the compositions in which they are incorporated of greater ecotoxicity than is allowable by law and by regulatory authorities in the area of intended use. Thus, quaternary ammonium compounds will usually be avoided, as will be compounds that have similar adverse effects on aquatic organisms, or the amounts thereof present will be limited so as to avoid such undesirable effects, Other materials that may be incorporated in the invented compositions include the usual adjuvants that normally are present in other fabric softening compositions (including softergents), such as perfumes, fixatives, solvents, cosolvents, hydrotropes, antioxidants, stabilizers, pH adjusters, buffers, biodegradable antimicrobials, builders, fillers, enzymes, thickeners and fluorescent brighteners, all of which are known classes of materials in the fabric softening compositions field, with examples of several of these being given in the art mentioned in this specification, all of which is hereby incorporated herein by reference.

The last component of the present compositions, which is present in those which are aqueous emulsions (or dispersions), is water. Normally any clean water can be employed, such as any of a hardness in the range of 0 to 500 p.p.m., as $CaCO_3$, but it will be preferred to use water of a hardness of no more than 150 p.p.m., more preferably less than 50 p.p.m., and most preferably the water will be deionized water that has been irradiated.

The previous description of the components of the invented products is primarily directed to components of the fabric softening compositions for addition to wash or rinse waters, especially during automatic washing processes, which are simpler embodiments of the invention but the invention also includes detergent compositions (softergents) that contain the described PEC and bentonite (or other suitable montmorillonite clay). Such detergent compositions will contain at least one synthetic organic detergent, preferably of the anionic or nonionic type (or a mixture thereof), which may also function as a dispersing agent for the PEC.

The anionic detergents are normally of the water soluble sulfate and/or sulfonated lipophile type, which may be designated "sulf(on)ated", and which include lipophile and sulf(on)ate moieties, but analogous phosph(on)ates may also be utilized. Of the synthetic anionic organic sulf(on)ated detergents those preferred are higher alkyl (preferably linear alkyl) benzene sulfonates, higher fatty alcohol sulfates, higher fatty alcohol ethoxylate sulfates, olefin sulfonates and paraffin sulfonates. Usually such compounds are water soluble alkali metal salts, such as sodium salts, and include higher fatty alkyl or other aliphatic moieties, which serve as lipophilic moieties, and which increase detergency, especially against greasy soils. Such higher alkyl or higher aliphatic moieties will normally be of 8 to 22 carbon atoms, preferably 10 or 12 to 16 or 18 carbon atoms and more preferably, especially for the alkyl sulfates and alkylbenzene sulfonates, the alkyl moieties will be of 12 to 14 carbon atoms. The higher fatty alcohol ethoxylate sulfates that are useful will normally be of 1 to 20 ethoxy groups per mol, preferably 3 to 10 or 15, e.g., 3 or 7. As representatives of anionic detergents there may be mentioned sodium linear dodecylbenzene sulfonate, sodium linear tridecylbenzene sulfonate, sodium lauryl alcohol sulfate, sodium coco alcohol triethoxylate sulfate, sodium $C_{16}$ paraffin sulfonate and sodium olefin sulfonate derived from $C_{14}$ olefin.

Among the nonionic detergents those which are most preferred are ethylene oxide condensates with higher fatty alcohols or with alkyl phenols, such as condensation products of 3 to 20, 5 to 15, 6 to 12 or 7 to 11 mols of ethylene oxide with higher fatty alcohols of 10 or 12 to 18 or 13 to 17 carbon atoms or with alkyl phenols of 7 to 10 carbon atoms in the alkyl groups, e.g., Dobanol® 25-7, Synperonic® A7, Neodol® 25-3, Neodol 25-3, Neodol 45-11, and $C_{13-17}$ alcohols condensed with 7 or 11 mols of ethylene oxide per mol. Although the improved softening obtained when bentonite is employed with a PEC is noticeable in anionic, nonionic and anionic/nonionic detergent compositions, such increase in softening action is even more surprising in the case of nonionic detergent compositions because PEC alone (without bentonite) has no fabric softening action at all in nonionic detergent compositions (but does have some such action in anionic detergents).

In addition to the above examples of suitable anionic and nonionic detergents, extensive listings of such detergents that are useful may be found in standard textbooks relating to synthetic organic detergents, such as the McCutcheon texts, previously cited.

Of the water soluble builders for the anionic and nonionic detergents it is preferred to employ water soluble salts, such as sodium or potassium salts, more preferably sodium salts, and of these the carbonates, silicates, borates, bicarbonates and phosphates, especially the polyphosphates, are preferred, such as sodium carbonate, sodium bicarbonate, sodium silicate of $Na_2O:SiO_2$ ratio in the range of 1:1.6 to 1:3, preferably 1:2 to 1:3, e.g., about 1:3, 1:2.35 or 1:2.4, sodium tripolyphosphate and tetrasodium pyrophosphate, but sodium sesquicarbonate and sodium sesquisilicate may also be used, as may be the corresponding potassium and other soluble salts, when suitable. Of the water insoluble builders, which builders also have water softening properties, the most preferred are the zeolites, especially the hydrated zeolites. Such zeolites include crystalline, amorphous and mixed crystalline and amorphous zeolites of both synthetic and natural origins, which are of satisfactorily quick and sufficiently effective activities in counteracting calcium hardness ions in wash waters. Preferably, the zeolites employed are characterized as having high exchange capacities for calcium ions, which exchange capacity is normally from about 200 to 400 milligram equivalents of calcium carbonate per gram of the zeolite. Although other ion exchanging zeolites may also be utilized, often the zeolite will be of the formula $$(Na_2O)_x.(Al_2O_3)_y.(SiO_2)_z.wH_2O,$$

wherein x is 1, y is from 0.8 to 1.2, z is from 1.3 to 3.5 and w is from 0 to 9, and preferably is 2.5 to 6. Of the crystalline zeolites that are useful those preferred include Zeolites A, X and Y, with A being more preferable, and the most preferred of these is Zeolite 4A. These zeolites are preferably in finely divided state when added to the crutcher with the synthetic detergent prior to drying, and are of ultimate particle diameters and actual sizes like those previously described for the bentonites. Other builders that may be utilized include organic compounds, which are often sequestrants for hardness ions. Such compounds include organic acids, especially hydroxy and amino polycarboxylic acids, such as citric and gluconic acids and ethylene diamine tetraacetic acid (EDTA) and nitrilotriacetic acid (NTA), all usually as their water soluble salts, e.g., sodium salts. Additional useful builders are the organophosphorus chelating agents, such as the Dequests®, e.g., Dequest 2046, which are manufactured by Monsanto Co.

The proportions of components of the invented compositions and articles will be those which result in stable and effective products for fabric softening applications. For the PEC's the concentrations in such liquid and gel softergent compositions will normally be in the range of about 1 to 25%, preferably 2 to 20%, more preferably 2 to 15% and most preferably 3 to 10%, e.g., about 5 or 6%. For the liquid rinse cycle and wash cycle additive compositions, such ranges are 1 to 40 parts (with 60 to 99 parts of bentonite) in a liquid medium, which is preferably aqueous. Preferably such compositions include 1 to 10% of PEC and more preferably, 3 to 7%, e.g., 6% or about 6%.

The particulate softergents will normally comprise 1 to 25% of PEC, preferably 2 to 20%, more preferably 2 to 15% and most preferably 3 to 10%, e.g., 6%, and for the particulate nondetersive rinse and wash water cycle additives such PEC content ranges may be 1 to 25% or 40%, 1 to 10%, 3 to 10% and 3 to 7%, e.g., 6%, respectively. For the dryer articles the operative, preferred, more preferred and most preferred ranges of PEC and bentonite) (or equivalent clay) contents are 5 to 99%,5 to 95%, 10 to 90% and 20 to 80%, respectively, with the proportion of PEC:bentonite being like corresponding proportions for the rinse and wash cycle additives.

The bentonite or suitable clay contents of the liquid or gel state softergents will be in the operative range of 1 to 50%, preferably 5 to 40%, more preferably 10 to 30% and most preferably 15 to 20%, e.g., 16% or 18%. For the particulate softergents such ranges are 10 to 30%, 10 to 25%, 12 to 20% and 15 to 20%, respectively. For the particulate and solid wash and rinse cycle additives the bentonite (or clay) percentages are in the operative, preferred, more preferred and most preferred ranges of 10 to 99%, 60 to 99%, 90 to 99% and 93 to 97%, e.g., 94%, or about 94%.

In the liquid or gel state and particulate softergents the operative percentage of synthetic organic detergent is 1 or 2 to 35%, preferably 3 to 25%, more preferably 3 to 20% and most preferably 5 to 15%. Preferably, the synthetic organic detergent will be a mixture of anionic and nonionic detergents, with. the percentages thereof being in the ranges of 1 to 10% of each, preferably 1 to 5% of each and more preferably 1 to 3% of anionic detergent and 3 to 5% of nonionic detergent, e.g., about 2% and about 4%, respectively. In the particulate or solid built softergents the percentages of builder(s) will normally be in the range of 5 to 80%, preferably being in the range of 10 to 60%, more preferably 20 to 50% and most preferably 30 to 40%, with the percentages of sodium tripolyphosphate, sodium carbonate and sodium silicate, when such three builders are present, often being in the ranges of 10 to 50%, 2 to 20% and 2 to 15%, respectively, preferably 15 to 35%, 2 to 10% and 2 to 10%, and most preferably 20 to 30%, 3 to 8% and 2 to 6%, e.g., about 23%, 6% and 4%, respectively. In liquid softergents such ranges of contents for synthetic detergents and for builders will often be multiplied by a factor that is proportional to the solids content of the liquid composition divided by the limiting solids contents of the range for the particulate or solid product. Normally, rinse cycle compositions will not contain any builders but wash cycle additives may utilize builders to improve cleaning of the detergent compositions with which such wash cycle compositions may be employed and also to act as supplemental carriers (in addition to the bentonite) for the PEC. In such cases, where builder is employed, the percentage ranges thereof will often be like those for the softergents.

For invented compositions that contain emulsifier(s) the content(s) of such emulsifier(s) will normally be in the range of 0.2 to 10%, preferably 0.4 or 0.5 to 5% and more preferably 0.7 or 1 to 3%, e.g., about 1.25 or 2%. When the emulsifier contains both an alkyl alkanolamine and an alkyl poly(ethylene oxide) ether, as may be preferred, the proportion of the alkanolamine will usually desirably be equal to or greater than that of the alkyl poly(ethylene oxide) ether alkanol, preferably being of 2 to 5 times as much, e.g., about 4 times as much. Thus, such percentages can be of 0.2 to 5% of the alkanolamine and 0.05 to 5% of the ether alkanol, preferably 0.3 to 3% and 0.1 to 2% and more preferably 0.5 to 2% and 0.2 to 1%. When no detergents, builders or adjuvants are present and the compositions are in liquid state, aqueous medium or water contents may be the balances thereof, which will usually be in the range of 20 to 98%, preferably 50 to 94%, more preferably 63 to 87%, and most preferably 81 to 74%, e.g., about 78%. It is to be understood that the presences of any detergents, builders, adjuvants or supplemental components of the emulsions will be compensated for by corresponding decreases in the water contents of the compositions. Usually the total adjuvants content will be no more than 25%, preferably will be no more than 15% and in many instances will be held to a limit of 5%. None of the adjuvants, in the amounts employed, will be such as to cause unacceptable levels of toxicity which could adversely affect aquatic organisms, including fish, that inhibit lakes and streams into which there are fed washing machine effluents that included the present compositions. Thus, the invented compositions may be considered to consist essentially of the named components, in additive or softergent form, with only environmentally acceptable proportions of adjuvants being allowed to be present therein. As was previously mentioned, the present compositions and articles are preferably essentially free of quaternary ammonium compounds. Most preferably 0% of such are present but when the resulting compositions and articles are not ecotoxic increasing limits of 0.1%, 0.3% and 0.5% may be imposed, which are more preferred, preferred and acceptable limits respectively, under such circumstances, and are within the broader invention. Although the described emulsifiers are more often employed in aqueous compositions, they may also be present in solid or particulate products and the proportions thereof in such products will be proportionally the same as for the liquids, on a solids basis.

A suitable adjuvant for the described products, especially for the rinse cycle additives, is an acidifying agent, such as hydrochloric or other suitable acid, which is useful to adjust the pH of the emulsion or other aqueous composition to within the range of 2.5 to 5.5, preferably 2.5 to 4, e.g., 3.5. To do that the percentage of HCl (concentrated basis) or equivalent other acidifying agent present will usually be in the range of 0.01 to 0.4%, preferably 0.05 to 0.2%. A sodium-containing compound may be present to provide sodium ions (alternatively, potassium compounds can be present) to convert alkaline earth or magnesium bentonite to swelling alkali metal bentonite, in which case the proportion employed will usually be at least stoichiometric, and may be up to 20% in excess of stoichiometric. Sodium hydroxide may be a suitable source of sodium ions, especially for the softergent compositions which are desirably alkaline.

To manufacture the invented solid, particulate and gel compositions and to make the described articles is comparatively simple, involving little more than mixings of components, (with gelling, agglomeration and application steps sometimes) but to produce applicants' dispersions a particular process is followed (and that is the process of the working examples. In such cases it is preferable that the PEC be melted before addition to the aqueous medium and the temperature to which the PEC is raised will desirably be within 10° C. of the melting point thereof. It is preferred that the PEC be mixed with any meltable emulsifier especially one of lipophilic character (or more lipophilic character than another emulsifier present), such as the alkanolamine, when a mixed alkanolamine/ether alcohol (or alkanolamine/ethoxylated alcohol) emulsifier is employed, and melted together with it, but alternatively the two meltable materials, PEC and alkanolamine, may be separately melted and added together or simultaneously to the aqueous medium (usually water), which should also be at about the same elevated temperature, about 60° C., for example. The smectite clay may be added before, with or after the emulsifier/PEC mixture. The water employed is often desirably acidified, as by addition to it of HCl or other suitable acid, to generate a final pH in the range of 2.5 to 5.5, preferably 2.5 to 4.0, e.g., about 3.5. After emulsification the emulsion produced may be cooled to room temperature, with the balance of emulsifier being added before or after such cooling, preferably before. The result is a stable emulsion, which resists separation under normal elevated temperature conditions for periods of six months or more.

To manufacture the particulate or powdered product it is only required for the PEC to be mixed with the smectite clay and any other components of the formulation. Preferably, the melted PEC, at elevated temperature, will be sprayed onto a tumbling mass of the particulate agglomerated smectite or montmorillonite powder (such as bentonite) or agglomerate thereof with any other particulate materials of the product, and with thereby be distributed throughout it evenly. Sometimes the mixer employed will include size reduction means to make sure the PEC is in small enough particles so as to be depositable evenly on the laundry being treated. The bentonite or other smectite clay particles may be at room temperature when the PEC is being applied to them and the PEC will be solidified on contact with the particulate mass, usually with little agglomeration taking place, but by controlling the PEC application, the temperature and mixer speed, some agglomeration may be obtainable, when desired.

To make the softening article it is usually desirable for the substrate material, in a continuous strip, to be passed through a melt, emulsion or other bath of PEC, with or without emulsifier, with any excess being removed by a doctor blade or squeeze rolls, and the bentonite or other acceptable clay may be applied to the PEC coated strip. After cooling or drying, the strip, containing the PEC and other materials, may be cut into individual pieces, which are then ready for use.

The softergents may be made in usual manners, with the PEC and bentonite being post-added or being added at a suitable stage of the manufacturing process, including crutching and spray drying, taking into account that they will not be subjected to destabilizing or destructive temperatures.

In use the various invented compositions and articles are employed in the same manners are other softergents, emulsions, powders and articles that apply fabric softener to laundry. Softergents may be charged to the washing machine as if they were detergents, with the desired concentrations being in the range of 0.1 to 1%, preferably 0.1 to 0.5%, e.g., about 0.15% in the U.S.A. and about 0.5% in Europe, to compensate for different washing conditions employed. The rinse cycle additive emulsion may be added to the rinse water and so may the powder and particulate compositions, with the concentrations of PEC being in the range of about 0.01 to 0.05% of the rinse water, and that of bentonite being proportionally greater, as previously described. Alternatively, such compositions may be added to the wash water but in such cases the concentrations may be increased, often about 1 to 3 times. Dryer treatment articles may be used in the same manner as products currently being marketed for that purpose, with paper strips (or towels) or equivalent sponges being added to the dryer, usually with a sheet or strip of 300 to 800 sq. cm. being employed.

The following examples illustrate but do not limit the invention. Unless otherwise indicated all parts and percentages in this specification and the appended claims are by weight, and all temperatures are in °C.

EXAMPLE 1

| Component | % By Weight |
|---|---|
| Sodium linear dodecylbenzene sulfonate | 2.00 |
| Stearyl hydroxyethyl imidazoline | 1.00 |
| *Nonionic detergent | 3.90 |
| **Sodium silicate | 4.00 |
| Sodium tripolyphosphate | 23.00 |
| Sodium carbonate, anhydrous | 6.00 |
| Ethylenediamine tetra(methylene phosphonic acid) sodium salt | 0.38 |
| ***Optical brightener | 0.21 |
| ****Methyl silicone | 0.18 |
| Sodium hydroxide | 1.00 |
| Sodium perborate tetrahydrate | 12.00 |
| °Proteolytic enzyme | 0.30 |
| °°Calcium montmorillonite swellable clay | 16.00 |
| Potassium methyl siliconate | 0.50 |
| Hydroxylamine sulfate | 0.30 |
| Perfume | 0.50 |
| Tetraacetyl ethylenediamine | 0.89 |
| Sodium aluminosilicate | 0.25 |
| °°°Pentaerythritol distearate | 6.00 |
| Sodium sulfate, anhydrous | 10.59 |
| Water | 11.00 |
| | 100.00 |

*Condensation product of one mol of mixed $C_{13-17}$ alcohols and seven mols of ethylene oxide
**$Na_2O:SiO_2$ ratio of 1:2
***Diaminostilbene disulfonic acid salt type
****Dow-Corning X2-3302
°Alcalase 2T
°°Calcium bentonite
°°°Commercial, 14% monostearate, 45% distearate and 40% tristearate A particulate built fabric softening detergent composition (a softergent) of the above formula is made by spray drying a portion of the formula to produce base beads, and then admixing such beads with a mixture of the remaining components, except for the perfume, which is sprayed onto the mixture of the beads and other materials. The spray dried beads are made by spray drying a crutcher mix of various heat stable components of the product, including sodium sulfate, sodium linear dodecylbenzene sulfonate, stearyl hydroxyethyl imidazoline, nonionic detergent, sodium silicate, sodium tripolyphosphate, sodium carbonate, ethylenediamine tetra(methylene phosphonic acid) sodium salt, optical brightener, silicone, sodium hydroxide, PEC and water, with the solids content of the crutcher mix being about 55%, to base beads of particle sizes in the range of 10 to 100, U.S. Sieve Series. The bentonite is agglomerated to the same particle size range and the agglomerated bentonite and the other components (usually those which are heat sensitive), including the sodium perborate tetrahydrate, the enzyme, the hydroxylamine sulfate and the sodium aluminosilicate, are admixed with the base beads, after which the siliconate and perfume are sprayed onto the mixture resulting, to make the final softergent. In a variation of the manufacturing procedure the PEC may be post-added to the composition in powdered form or as a co-agglomerate with bentonite.

The softergent produced and variations of the formula, in which percentages of the bentonite and PEC are varied while all the other percentages of components remain the same, except for the sodium sulfate, which is changed to compensate for increases or decreases in the total of bentonite and PEC, are made and are tested for detergency and fabric softening effectivenesses. In tests against various oily and clayey soils the softergent is found to be an effective and commercially acceptable detergent, using visual observations of the cleaning of soiled laundry and test swatches as well as reflectometer reading comparisons with controls. When tested against the best commercial softergent known to the present inventors, which composition includes clay, tertiary amines, polysiloxanes and soap or quaternary ammonium compound, the invented composition of the formula given above is as good as such "ultimate" composition or better in fabric softening effect, using 60° C., washing machine laundering of ordinary wash loads of dirty laundry or test swatches, whether the washing machines and procedures are of the American or European type, and whether the materials of the items washed are natural, such as cotton, synthetic, such as polyester, or blends thereof. In such tests a panel of experienced evaluators, usually at least four, compares washed swatches (or identical items), one of which was washed by a control detergent composition and the other of which was washed using a softergent that is being evaluated. The difference in softness between the swatches washed with the control detergent and the softergent is judged and a number is assigned to indicate such difference, with 1 being for a slight difference, 2 being for a moderate difference and 3 being for a great difference. In all cases, of course, the swatches washed with the softergent will be softer than the control, which was washed in wash water that contained a detergent composition from which the softening bentonite-PEC combination had been omitted.

When the invented softergent of the formula of this example is tested against a control detergent, from which the bentonite and PEC were omitted and replaced by sodium sulfate, an inert filler, the difference in softening effect is rated at 2.3. When the 6% of PEC is in the formula but the bentonite is omitted and is replaced by sodium sulfate the rating is 0.7 and when the PEC is replaced by sodium sulfate and the bentonite (16%) is present, the rating is 0.8. Thus, the additive effect of the PEC only and bentonite only formulas would be 1.5 whereas actually it is found to be 2.3, which represents a very significant improvement (synergism). Even greater fabric softening action is obtainable, as will be evident by reference to the appended drawing, which also shows that merely increasing the proportion of either bentonite or PEC does not yield the same improvement; in fact, increasing the proportions of bentonite to 30% and PEC to 20% (separately) results in decreasings of the softening actions.

Figure 2:
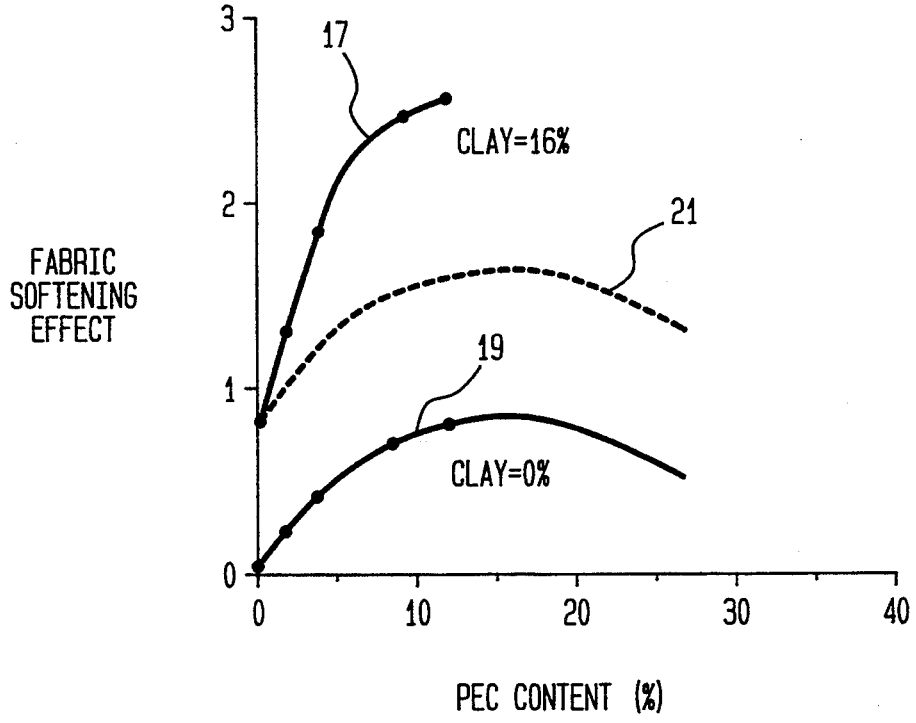

The synergistic result with respect to fabric softening actions of the invented softergents will readily be apparent from the appended drawing, in which:

FIG. 1 is a plot of fabric softening effect of a composition of the basic formula of Example 1 of this specification, with the bentonite content being varied, compared to such softening effect of similar compositions in which the bentonite content is varied and the PEC content is 0%; and FIG. 2 is a plot of fabric softening effect of a composition of the basic formula of Example 1, with the PEC content being varied, compared to such effect in similar compositions in which the PEC content is varied and the bentonite content is 0%.

In FIG. 1 curve 11 shows the increase in fabric softening action on the washed laundry as the bentonite content is increased from 0 to 25% , with the dots on the curve representing specific bentonite contents. The best softening obtained is rated at about 2.7, which is about the best ever obtained with a softergent. Curve 13 illustrates fabric softening action as the bentonite content is increased, with the PEC being omitted from the formula. It is notable that the curve heads downwardly, indicating less softening, when the bentonite content is over 25%. Phantom curve 15 shows the expected additive effect on fabric softening action of the 6% of PEC plus the indicated percentages of bentonite. Because curve 15 is substantially lower than curve 11 for most of its length it proves that a synergistic fabric softening effect attends the presence of both bentonite and PEC in the described aoftergent compositions FIG. 2 is similar to FIG. 1 except that in the FIG. 2 experiments it is the clay (bentonite) content that is being held constant while that of the PEC is being varied, from 0 to 20%. Curve 17 shows the increase in fabric softening action of softergents of the invention which contain 16% of clay and from 1 to 10% of PEC, while curve 19 shows that when the clay content is 0% the increase in softening action as the PEC content is increased is at a lower rate, and softening actually decreases at higher PEC contents. Curve 21 plots the expected (additive) effect of 16% of clay plus the indicated percentages of PEC. Because such curve is substantially lower than the actual curve 17 it is established that the combination of bentonite and PEC synergistically improves fabric softening of laundry washed with such softergents.

The described effect, synergistic improvement of fabric softening action, is also obtained with various other combinations of PEC's described herein and montmorillonite clays of the types mentioned but the best results are obtained when the PEC's are partial esters of pentaerythritol and pentaerythritol oligomers which include at least one, and preferably two hydroxyls, and when the clay is a calcium bentonite or a sodium or potassium bentonite that is capable of swelling in the wash water. In the experiments described above and plotted in the graphs of the figures the bentonite employed is calcium bentonite and there is enough sodium ion in the wash water (from the builder salts and the sodium hydroxide) to convert it to swelling sodium bentonite. Surprisingly enough, the calcium bentonite, when employed under such conditions, is even better in fabric softening power than the sodium and potassium bentonites.

Another significant advantage of the invented softergents of this invention is in the breaking through of a perceived "softening barrier" by the invention. From FIG's. 1 and 2 it is evident that increasing the contents of either bentonite or PEC alone will not result in a superior softergent because the softening effects asymptotically approach limits less than or about 1 and even the additive effects which could be predicted are less than 2, and in all such cases the fabric softenings are diminished as greater proportions of the mentioned softening agents are employed. Yet, with the invented compositions this apparent limit on softening power is transcended and lesser total quantities of the combination of PEC and bentonite yield superior results, with the fabric softening effects approaching those for rinse cycle additive compositions, which had previously been considered to be "an impossible dream". Such effects are obtainable with other types of softergents, including those based on nonionic detergents only, anionic detergents only, water insoluble builders, such as zeolites, non-phosphate formulas, in which the builder composition can be a combination of zeolite, carbonate and silicate, and softergents built with organic builders, such as polyacetal carboxylates, NTA, EDTA, citric acid and gluconic acid. Furthermore, such synergistic softening actions are also obtainable for wash cycle and rinse cycle additive softening compositions, which contain no detergent, and in such rinse cycle additive compositions, whether in liquid state or in particulate or gel form, softening action can be better than for such compositions which do not utilize the described combination of clay and PEC.

EXAMPLE 2

| Component | % By Weight |
|---|---|
| Sodium linear dodecylbenzene sulfonate | 3.00 |
| Stearyl hydroxyethyl imidazoline | 1.50 |
| *Nonionic detergent | 3.50 |
| Sodium silicate ($Na_2O:SiO_2$ = 1:2) | 5.50 |
| Zeolite 4A | 19.00 |
| Sodium maleate methacrylate copolymer | 1.10 |
| Sodium carboxymethyl cellulose | 0.50 |
| Sodium carbonate, anhydrous | 4.00 |
| Ethylenediamine tetra(methylenephosphonic acid), sodium salt | 0.44 |
| Stilbene optical brightener | 0.25 |
| Sodium hydroxide | 0.10 |
| Proteolytic enzyme (Alcalase ® 2T) | 0.36 |
| Sodium perborate tetrahydrate | 10.60 |
| Calcium montmorillonite clay (calcium bentonite) | 18.00 |
| Hydroxylamine sulfate | 0.50 |
| Tetraacetylethylenediamine | 1.00 |
| Sodium aluminosilicate | 0.40 |
| Sodium ethylenediamine tetraacetate | 0.13 |
| ***Pentaerythritol distearate | 3.00 |
| Sodium sulfate, anhydrous | 19.07 |
| Water | 7.50 |
| Perfume | 0.55 |
| | 100.00 |

*Condensation product of one mol of mixed $C_{13-17}$ alcohols and seven mols of ethylene oxide
***Mixture of 14% of the monostearate, 45% of the distearate and 40% of the tristearate The particulate product of this example is made by a procedure described in Example 1, and when tested for detergency and fabric softening properties according to the procedures set forth in that example, exhibits good detergency and synergistic fabric softening, due to its contents of PEC and bentonite. The synergistic improvement in fabric softening, compared to the expectable effects of the individual PEC and bentonite in such composition, is not as striking as in Example 1 (wherein 6% of PEC and 16% of bentonite were present) but is significant. In variations of this non-phosphate formula the PEC content is decreased to 1.5%, with a corresponding increase in sodium sulfate content to 20.57%, and synergistic fabric softening is still noted, but to a lesser extent. When the PEC content is increased to 6% and the sodium sulfate content is decreased to 16.07% to compensate, the synergistic fabric softening effect is even more pronounced.

EXAMPLE 3

| Component | % By Weight |
|---|---|
| *Nonionic detergent | 12.00 |
| Sodium silicate ($Na_2O:SiO_2$ = 1:2) | 5.50 |
| Zeolite 4A | 23.00 |
| Sodium maleate methacrylate copolymer | 1.50 |
| Sodium carboxymethyl cellulose | 0.55 |
| Sodium carbonate, anhydrous | 13.00 |
| Ethylenediamine tetra(methylenephosphonic acid) sodium salt | 0.65 |
| Stilbene optical brightener | 0.30 |
| Sodium hydroxide | 0.15 |

-continued

| Component | % By Weight |
|---|---|
| Sodium perborate monohydrate | 9.00 |
| Proteolytic enzyme (Alcalase 2T) | 0.70 |
| Calcium bentonite | 18.00 |
| Hydroxylamine sulfate | 0.50 |
| Tetraacetylethylenediamine | 3.86 |
| Sodium aluminosilicate | 0.50 |
| ***Pentaerythritol distearate | 3.50 |
| Water | 6.54 |
| Perfume | 0.75 |
| | 100.00 |

*Condensation product of one mol of mixed $C_{13-17}$ alcohols and seven mols of ethylene oxide
***14% of the monostearate, 45% of the distearate and 40% of the tristearate The zeolite-built, non-phosphate, nonionic particulate detergent composition of this example is made by the process or processes of Examples 1 and 2 and is tested for detergency and fabric softening properties in the same manner. It is a good nonionic detergent and does not have the ecologically disadvantageous properties of phosphates or non-biodegradable anionic detergents. Also, due to its content of calcium bentonite and PEC it is of excellent fabric softening properties, synergistically better than would have been expected from the additive effects of the fabric softening agents present in the formula (and PEC is biodegradable).

To improve detergency of the composition even more one may incorporate in it an anionic detergent of the biodegradable type, such as 5% of sodium lauryl sulfate or 10% of sodium $C_{14-15}$ paraffin sulfonate, and in some instances such anionic detergents may replace the nonionic detergent, with the total detergent content being about the same as in the formula of this example. Such products also exhibit the excellent fabric softening properties of the formula of this example and such fabric softening is synergistically improved over the additive effects of the fabric softening components of the product.

EXAMPLE 4

| Component | % By Weight |
|---|---|
| Sodium linear tridecylbenzene sulfonate | 6.00 |
| +Neodol ® 25-7 | 4.00 |
| Pentaerythritol distearate | 7.00 |
| Swellable calcium bentonite | 18.00 |
| Sodium carbonate | 8.00 |
| Sodium silicate ($Na_2O:SiO_2$ = 1:2.4) | 4.00 |
| ++Emulsifier | 2.00 |
| Water | 51.00 |
| | 100.00 |

+Nonionic detergent which is a condensation product of a fatty alcohol of 12–15 carbon atoms, with 7 mols of ethylene oxide
++Mixture of 4 parts of N-stearyl diethanolamine and 1 part of $C_{12-15}$ alkyl decaethoxy ethanol This basic liquid softergent formula yields an excellent cleaner and fabric softener, which exhibits the synergism of the fabric softening components, previously described in Examples 1–3.

EXAMPLE 5

| Component | % By Weight |
|---|---|
| Calcium bentonite | 93.7 |
| Pentaerythritol dipalmitate | 5.8 |
| Sodium hydroxide | 0.5 |

-continued

| Component | % By Weight |
|---|---|
| | 100.0 |

This basic formula for a particulate or powder wash cycle additive (for addition to ordinary wash waters containing non-softening detergent compositions) is made by mixing the sodium hydroxide, in powder or aqueous solution form, with the bentonite and then melting the PEC and spraying or dripping it onto the surfaces of a moving mass of the bentonite (+NaOH), to produce an agglomerate or powder. When such is added to the wash water in such a proportion to result in 0.06% of PEC in the wash water and proportionately more calcium bentonite, laundry washed with the wash water resulting exhibits unexpectedly improved fabric softening properties of the wash water. Instead of being in particulate or powder form the wash cycle additive may be in liquid form, in which 2% of an emulsifier may be present, too, and the water content may be about 70 to 90%, e.g., 80%.

Alternatively, a rinse cycle softener composition may be made of essentially the same formula as that given for the particulate product, with the bentonite being sodium bentonite and the sodium hydroxide being replaced by hydrochloric acid so as to make the product acidic. Similarly, liquid rinse cycle compositions may be manufactured, without detergent or builder being present, and with emulsifier to help to maintain the liquid product homogeneous. In such products the water content may be like that of the liquid wash cycle additives, but with water also replacing the detergent(s) and builder(s), and the pH would be in the range of 2.5 to 5.5, e.g., 3.5. In a similar manner gel products can be made, with 0.5 to 5% of a gelling agent, such as 3% of sodium alginate, being present, and with the other components being the same as for the liquid product (with the water content being diminished to compensate for the gelling agent's presence). If desired, the concentrations of bentonite and PEC may be decreased in the rinse cycle compositions and will still be effective, e.g., when reduced to $\frac{1}{3}$ the concentrations in the softergents.

The described compositions, all of which contain both bentonite and PEC, are all effective fabric softening agents and exhibit synergistic softenings like those described in the data given previously and in the drawing,

EXAMPLE 6

| Component | % By Weight |
|---|---|
| Calcium bentonite | 16.0 |
| Sodium hydroxide | 0.2 |
| ⁰⁰⁰Pentaerythritol distearate | 6.0 |
| ++Emulsifier | 3.0 |
| Water | 74.8 |
| | 100.0 |

⁰⁰⁰14% Monostearate, 45% distearate and 40% tristearate
++Mixture of four parts of N-stearyl diethanolamine and one part of $C_{12-15}$ alkyl decaethoxy ethanol The components listed are mixed together to form a wash cycle additive suspension that improves fabric conditioning by the wash water containing the suspension. The concentrations of all the components except water may be halved or reduced to thirds, with the water content being increased to compensate, and the resulting suspension may be used for rinse cycle softening. Alternatively, the formula product may be used directly for rinse cycle softening of the washed laundry, employing normal charges of such softener to the rinse water, often about 1.3 fluid ounces of a 64 liter last rinse.

Synergistically improved fabric softening results, like that mentioned previously in the other examples, for both types of uses.

EXAMPLE 7

| Component | % By Weight |
|---|---|
| Cellulosic Sponge | 13.0 |
| Sodium bentonite | 54.0 |
| ⁰⁰⁰Pentaerythritol distearate | 18.0 |
| ++Emulsifier | 5.0 |
| Water | 10.0 |
| | 100.0 |

⁰⁰⁰See Example 6.
++See Example 6.

The PEC, bentonite and emulsifier are mixed together with half the water and the sponge is moistened with the other half of the water, after which the sponge is charged with the mixture of the other components and the water is allowed to evaporate. The resulting product is employed to soften laundry while it is being dried in an automatic laundry dryer. The laundry is softened satisfactorily and the previously described synergistic softening is obtained. In a similar procedure paper towelling is charged with the mix and is employed as a dryer softening agent, with essentially the same results.

EXAMPLE 8

In this example cotton terrycloth swatches are washed in an automatic washing machine in a 60° C. wash water containing 0.5% of a softergent composition of the formula of Example 1, rinsed and dried. Other such swatches are washed in conventional detergent compositions, which may be of the same formula except for the omission of the bentonite and PEC, which are replaced by inert filler (sodium sulfate), and are then rinsed (in the last rinse), with rinse water to which any quaternary ammonium or amine salt rinse cycle fabric softening composition has been added, such as dimethyl distearyl ammonium chloride, so that the rinse water contains about 0.05% (or more) of the fabric softening quat or amine, and such swatches are dried.

Strips are cut of swatches subjected to these different treatments and are tested for water absorption, by dipping lower ends of such vertical strips into an aqueous solution of water soluble dye (red Iragon) and measuring the heights to which the water rises, after 30 seconds, 1 minute, 3 minutes and 5 minutes. The strips washed with the invented softergent absorb water to heights that are about twice those for the strips from the swatches that are washed, as described, and then treated with the rinse cycle softener.

Similar results are obtainable by utilizing rinse cycle fabric softeners of this invention, in which PEC and bentonite are present, when they are compared to rinse cycle fabric softening compositions that are based on quat and/or amine fabric softeners. Nevertheless, the invented softergents and rinse cycle compositions soften the cotton (and other fabrics) about as well as the best of comparable softening compositions, which is an exceptional result.

The results of these tests and similar absorption tests on towelling and clothing are important because they show that fabrics treated with the invented compositions, instead of commercial quat-based products, are more capable than such products of absorbing water (which is important for towels) and body sweat (which is important for clothing items, such as underwear, T-shirts and sport apparel).

In the illustrative examples of the invention given above various changes may be made within the invention and the described synergistic results will still be obtained. For example, various other swellable bentonites and montmorillonites may be substituted for the calcium and sodium bentonites and other PEC's may be employed, including dipentaerythritol tetralaurate, monopentaerythritol 10 ethylene oxide distearate and pentapentaerythritol tetrapalmitate. Different detergents, PEC's and clays like those mentioned may be employed and various adjuvants and active components may be included in the compositions and articles of the invention, and so long as the combination of the acceptable clay and PEC is present the synergistic fabric softening action is obtainable. Such is also the case when proportions are varied within the ranges mentioned and when different concentrations of the products are employed, within the ranges given.

In all variations, when the bentonite and the PEC of the invention are present improved softening results, possibly due to the mutual promotion of adherence to the laundry fibers of each of the required softeners, and sometimes to the desirable dispersing effect of the bentonite on the PEC. However, it seems that the synergism obtained is due to more than the mentioned adherence promoting and dispersing effects, and applicants are not bound by any theories mentioned herein.

The invention has been described with respect to illustrations and examples thereof but is not to be considered as being limited to those because it is evident that one of skill in the art, with the present specification before him or her, will be able to utilize substitutes and equivalents without departing from the invention.

What is claimed is:

1. A fabric softening product for application to fibrous materials so that a fabric softening component thereof is deposited on the fibrous materials and softens them, which product is selected from the group consisting of A) liquid and gel state rinse cycle and wash cycle additive compositions and dryer articles, B) liquid and gel state detergent compositions, C) particulate and solid detergent compositions and D) particulate and solid wash and rinse cycle additive compositions, each of which comprises pentaerythritol derivatives, which is a fabric softening component thereof, selected from the group consisting of a higher aliphatic acid ester of pentaerythritol, an oligomer of pentaerythritol, a lower alkylene oxide derivative of pentaerythritol, a lower alkylene oxide derivative of an oligomer of pentaerythritol, or a mixture thereof, and a montmorillonite clay, and said composition being essentially free of quaternary ammonium fabric softener, with the proportions of pentaerythritol derivative: clay being in the range of 1–40:99–60 for the A products, 1–25:1–50 for the B products, 1–25:10–30 for the C products and 1–25:10–99 for the D products, with all proportions being by weight.

2. A fabric softening product according to claim 1 which is a wash cycle or rinse cycle composition, a dryer article or a detergent, in which the montmorillonite clay is capable of swelling in use.

3. A fabric softening product according to claim 2 in which the montmorillonite clay is a sodium, potassium, calcium or magnesium bentonite or mixture of two or more thereof, and the pentaerythritol derivative is a partial higher aliphatic ester of pentaerythritol or of an oligomer of pentaerythritol.

4. A fabric softening product according to claim 3 which is free of quaternary ammonium compound fabric softener.

5. A fabric softening product according to claim 3 which is detergent, which detergent is one which comprises synthetic organic detergent selected from the group consisting of anionic and nonionic types and mixtures thereof, pentaerythritol compound and bentonite.

6. A detergent composition according to claim 5, in particulate form, wherein the synthetic organic detergent is 3 to 35% thereof, the pentaerythritol derivative is 2 to 20% thereof and the bentonite is 10 to 30% thereof.

7. A particulate detergent composition according to claim 6 wherein the synthetic organic detergent is a mixture of anionic and nonionic detergents, and the proportion thereof is in the range of 3 to 25%, the composition is built with 10 to 60% of builder, and the proportions of pentaerythritol derivative and bentonite are in the ranges of 2 to 15% and 10 to 25%.

8. A particulate detergent composition according to claim 7 wherein the anionic detergent is selected from the group consisting of sulfated and sulfonated detergents and mixtures thereof, the nonionic detergent is a condensation product of a higher fatty alcohol and ethylene oxide, the builder is selected from the group consisting of water soluble alkali metal polyphosphates, carbonates, silicates, borates, citrates, bicarbonates, gluconates, nitrilotriacetates, ethylene diamine tetraacetates, water insoluble water softening zeolites, and mixtures thereof, the pentaerythritol derivative is a higher aliphatic acid partial ester of pentaerythritol or of an oligomer of pentaerythritol, and the bentonite is selected from the group consisting of sodium and calcium bentonites and mixtures thereof.

9. A particulate detergent composition according to claim 8 which comprises 1 to 10% of sodium higher alkylbenzene sulfonate, 1 to 10% of nonionic detergent, which is a condensation product of one mol of higher fatty alcohol and 5 to 10 mols of ethylene oxide, 2 to 10% of sodium silicate, 15 to 35% of sodium tripolyphosphate, 2 to 10% of sodium carbonate, 3 to 10% of higher aliphatic acid partial ester of pentaerythritol and 12 to 20% of sodium or calcium bentonite or a mixture thereof.

10. A particulate detergent composition according to claim 9 wherein the higher aliphatic acid partial ester of pentaerythritol is pentaerythritol distearate and the bentonite is calcium bentonite.

11. A detergent composition according to claim 5, in liquid or gel form, which comprises 3 to 20% of the synthetic organic detergent, 2 to 20% of the pentaerythritol derivative and 10 to 30% of the bentonite, in an aqueous medium.

12. A fabric softening rinse cycle or wash cycle additive product according to claim 4 which is in particulate or powder form and comprises about 1 to 40% of the pentaerythritol derivative and about 60 to 99% of particulate or powder bentonite.

13. A fabric softening product according to claim 12 in which the pentaerythritol derivative is dispersed in the bentonite, which serves as a carrier for it.

14. A fabric softening product in particulate or powder composition form, according to claim 13, which comprises 1 to 10% of a higher aliphatic acid partial ester of pentaerythritol or a higher aliphatic acid partial ester of an oligomer of pentaerythritol, or a mixture thereof, and 90 to 99% of bentonite.

15. A fabric softening composition according to claim 14 which comprises 3 to 7% of higher fatty $C_{12-18}$ partial ester of pentaerythritol and 93 to 97% of sodium bentonite or calcium bentonite.

16. A fabric softening composition according to claim 15 in which the pentaerythritol derivative is pentaerythritol distearate, the bentonite is calcium bentonite, and ionizable sodium compound is present in the composition to convert the calcium bentonite to sodium bentonite in wash or rinse water.

17. A composition according to claim 16 which comprises about 6% of pentaerythritol distearate and about 94% of calcium bentonite.

18. A composition according to claim 3 which is in liquid form and comprises about 1 to 40 parts of the pentaerythritol derivative and about 60 to 99 parts of bentonite in a liquid medium.

19. A composition according to claim 18 which comprises 1 to 10% of a higher aliphatic acid partial ester of pentaerythritol or of an oligomer of pentaerythritol, 10 to 30% of bentonite and 50 to 89% of an aqueous medium.

20. A composition according to claim 19 which comprises 3 to 7% of higher fatty $C_{12-18}$ partial ester of pentaerythritol, 10 to 24% of bentonite selected from the group consisting of sodium bentonite, calcium bentonite and mixtures thereof, and 60 to 85% of an aqueous medium which is substantially water.

21. A fabric softening wash cycle additive composition according to claim 19 which comprises about 6% of pentaerythritol distearate, about 16% of calcium bentonite and 65 to 76% of water.

22. A fabric softening dryer article according to claim 2 which comprises an absorbent fibrous or cellular material which has deposited on it or absorbed thereby about 1 to 25% of the fabric softening component, on a fabric softening article basis.

23. A fabric softening article according to claim 22 which comprises a sheet of paper which has been impregnated with 5 to 95% of fabric softening component which comprises a partial higher fatty ester of pentaerythritol, a partial ester of an oligomer of pentaerythritol or a mixture thereof, and bentonite.

24. A process for softening laundry which comprises applying to such laundry a fabric softening product of claim 2 in such manner and under such conditions that a fabric softening component thereof is deposited on the laundry and softens it.

25. A process according to claim 24 wherein the fabric softening product applied to the laundry is a detergent composition which comprises 1 to 35% of a synthetic organic detergent selected from the group consisting of anionic and nonionic detergents and mixtures thereof.

26. A process according to claim 24 wherein the fabric softening product is a rinse or wash cycle composition which comprises a pentaerythritol derivative and bentonite, which is applied to the laundry in the wash water or in the rinse.

27. A process according to claim 24 wherein the fabric softening product is a dryer article containing a pentaerythritol derivative and bentonite, which is applied to the laundry in a laundry dryer, which article is of an absorbent fibrous or cellular material which has had deposited on it or absorbed by it a pentaerythritol compound and bentonite.

* * * * *